US008096083B2

(12) United States Patent
Ma et al.

(10) Patent No.: US 8,096,083 B2
(45) Date of Patent: Jan. 17, 2012

(54) HEALTH BOOTH

(76) Inventors: Yen-Chung Ma, Taichung (TW); Yen-Ping Ma, Taichung (TW)

( * ) Notice: Subject to any disclaimer, the term of this patent is extended or adjusted under 35 U.S.C. 154(b) by 159 days.

(21) Appl. No.: 12/714,546

(22) Filed: Mar. 1, 2010

(65) Prior Publication Data

US 2011/0209417 A1 Sep. 1, 2011

(51) Int. Cl.
*E04H 1/14* (2006.01)
*A47B 9/00* (2006.01)

(52) U.S. Cl. ..... 52/36.2; 52/36.4; 52/64; 52/79.1; 108/147; 108/48

(58) Field of Classification Search ..... 52/79.1, 52/64, 36.2, 234, 173.1, 36.1; 600/300, 301, 600/21, 22; 108/115, 116, 134, 135, 147.11, 108/147.17, 147, 108, 152; 211/171; 297/14, 297/452.39
See application file for complete search history.

(56) References Cited

U.S. PATENT DOCUMENTS 5,528,993 A * 6/1996 Vincelli ..... 108/48
5,655,459 A * 8/1997 O'Connor et al. ..... 108/48
5,897,325 A * 4/1999 Koby-Olson ..... 434/432
6,109,189 A * 8/2000 Tarver ..... 108/48
6,205,716 B1 * 3/2001 Peltz ..... 52/36.2
6,457,686 B1 * 10/2002 Hill ..... 248/176.1
6,510,803 B1 * 1/2003 Agee ..... 108/147
6,729,685 B1 * 5/2004 Ebalobor ..... 297/14
7,080,417 B2 * 7/2006 Jiang ..... 4/578.1
7,464,652 B2 * 12/2008 Hauck ..... 108/48
7,908,981 B2 * 3/2011 Agee ..... 108/147
2009/0249982 A1 * 10/2009 Palethorpe ..... 108/44

* cited by examiner

*Primary Examiner* — Brian Glessner
*Assistant Examiner* — Beth Stephan

(57) ABSTRACT

A health booth includes a telescopic and pivotal board including two telescopic units having one ends pivotably attached to a board; a seat assembly including two parallel columns mounted on the other side wall, a horizontal bar slidably put on the columns, a telescopic support post mounted between the horizontal bar and a bottom, and a collapsible seat secured to the horizontal bar, and a pivot assembly including a channel mounted onto one side wall, two torsion springs in the channel, two outer cylindrical members each together with one inner cylindrical member to dispose the other ends of the telescopic units therein, and two groups of a plurality of fasteners wherein each group of the fasteners are driven through the outer cylindrical member into the inner cylindrical member to fasten the other ends of the telescopic units.

3 Claims, 12 Drawing Sheets

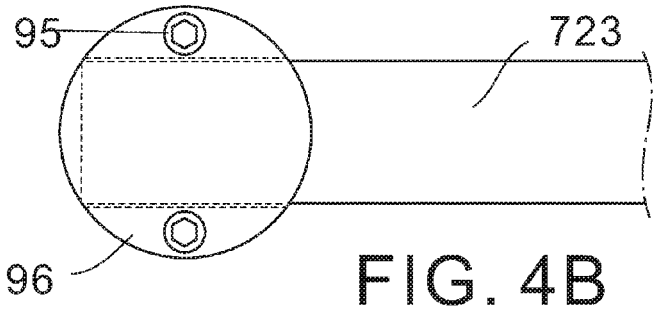
FIG. 4B
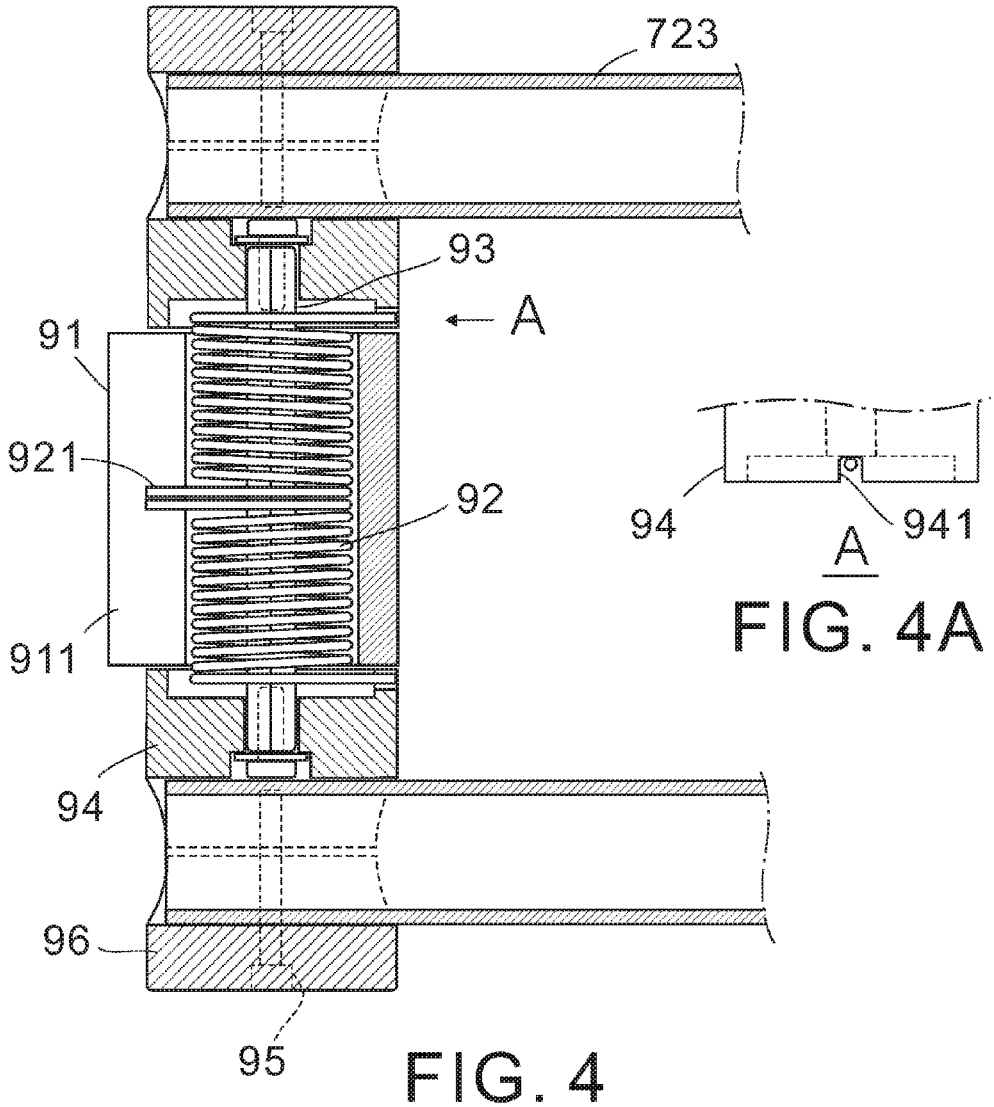
FIG. 4A
FIG. 4

HEALTH BOOTH

BACKGROUND OF THE INVENTION

1. Field of Invention

The invention relates to health equipment and more particularly to a health booth with improved characteristics.

2. Description of Related Art

Infrared (IR) radiation can be used as a heating source. For example, it is used in infrared saunas to heat the occupants. Far infrared (FIR) is also gaining popularity as a safe method of natural health care and physiotherapy. FIR thermometric therapy garments use thermal technology to provide compressive support and healing warmth to assist symptom control for injury and pain.

Moreover, an endless array of health equipment is commercially available. Health improvements of such prior health equipment are not significant. Further, it is costly to manufacture and unreliable in use. Thus, continuing improvements in the exploitation of health equipment are constantly being sought.

SUMMARY OF THE INVENTION

It is therefore one object of the invention to provide a health booth comprising a door; a rectangular top; a rectangular bottom having a positioning hole; a rectangular rear wall; a rectangular first side wall; a rectangular second side wall opposite the first side wall; a telescopic and pivotal board comprising a board and two parallel telescopic units each having one end pivotably attached to the board; a seat assembly comprising two parallel columns mounted on the second side wall, a horizontal bar having both ends slidably put on the columns, a telescopic support post having an upper end secured to the horizontal bar and a lower end fastened in the positioning hole, and a collapsible seat secured to the horizontal bar, and a pivot assembly comprising a channel of substantially C-section mounted onto the first side wall, the channel having a side opening, two inner cylindrical members each having an aperture, two aligned biasing members in the channel wherein one biasing member has one end anchored in the side opening and the other end anchored in the aperture, and the other biasing member has one end anchored in the aperture and the other end anchored in the side opening, a bolt inserted through the biasing members and having both ends fastened in the inner cylindrical members respectively, two outer cylindrical members each together with one of the inner cylindrical members to dispose the other ends of the telescopic units therein, and two groups of a plurality of fasteners wherein each group of the fasteners are driven through the outer cylindrical member into the inner cylindrical member to fasten the other ends of the telescopic units so that a pivotal movement of the telescopic units twists the ends of the torsion springs anchored in the apertures via the inner cylindrical members.

The above and other objects, features and advantages of the invention will become apparent from the following detailed description taken with the accompanying drawings.

BRIEF DESCRIPTION OF THE DRAWINGS

FIG. 4 is a cross-sectional view of the pivot assembly of FIG. 3;

FIG. 4A is a side elevation of the inner cylindrical member of FIG. 4 as indicated by arrow A;

FIG. 4B is a side elevation of the pivot assembly of FIG. 4;

DETAILED DESCRIPTION OF THE INVENTION

Figure 1:
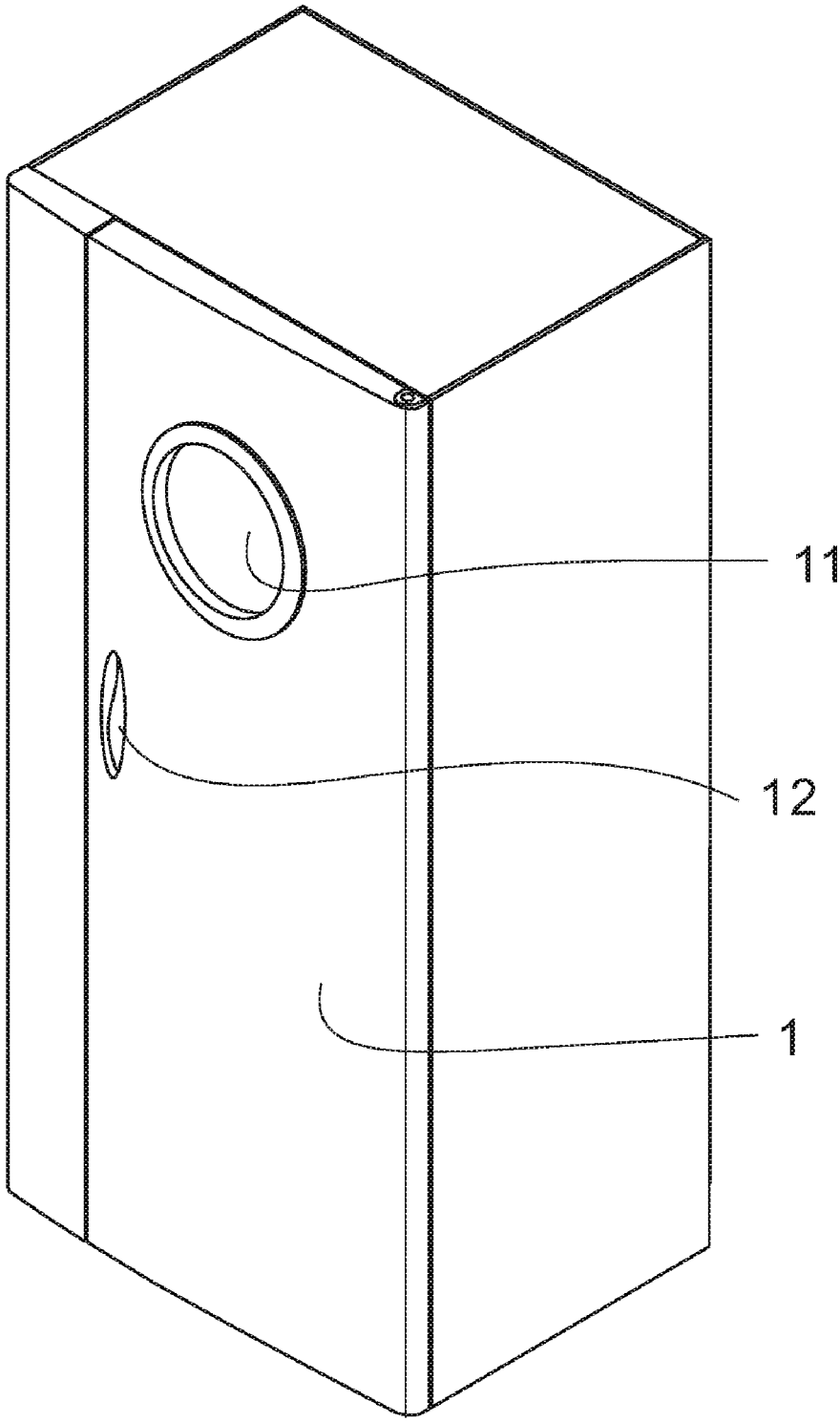
FIG. 1 is a perspective view of a preferred embodiment of health booth according to the invention.
Figure 2:
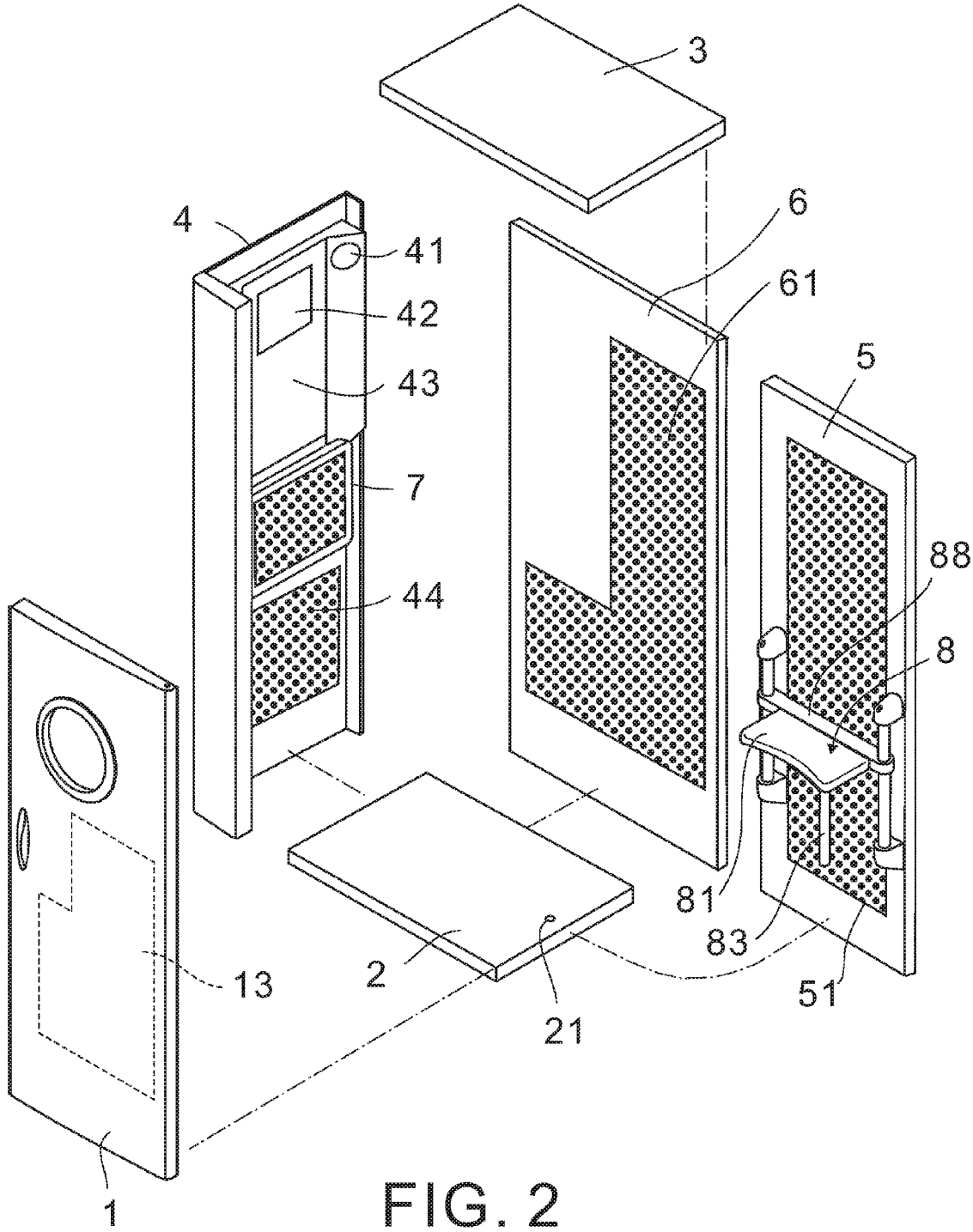
FIG. 2 is an exploded view of the health booth.
Figure 3:
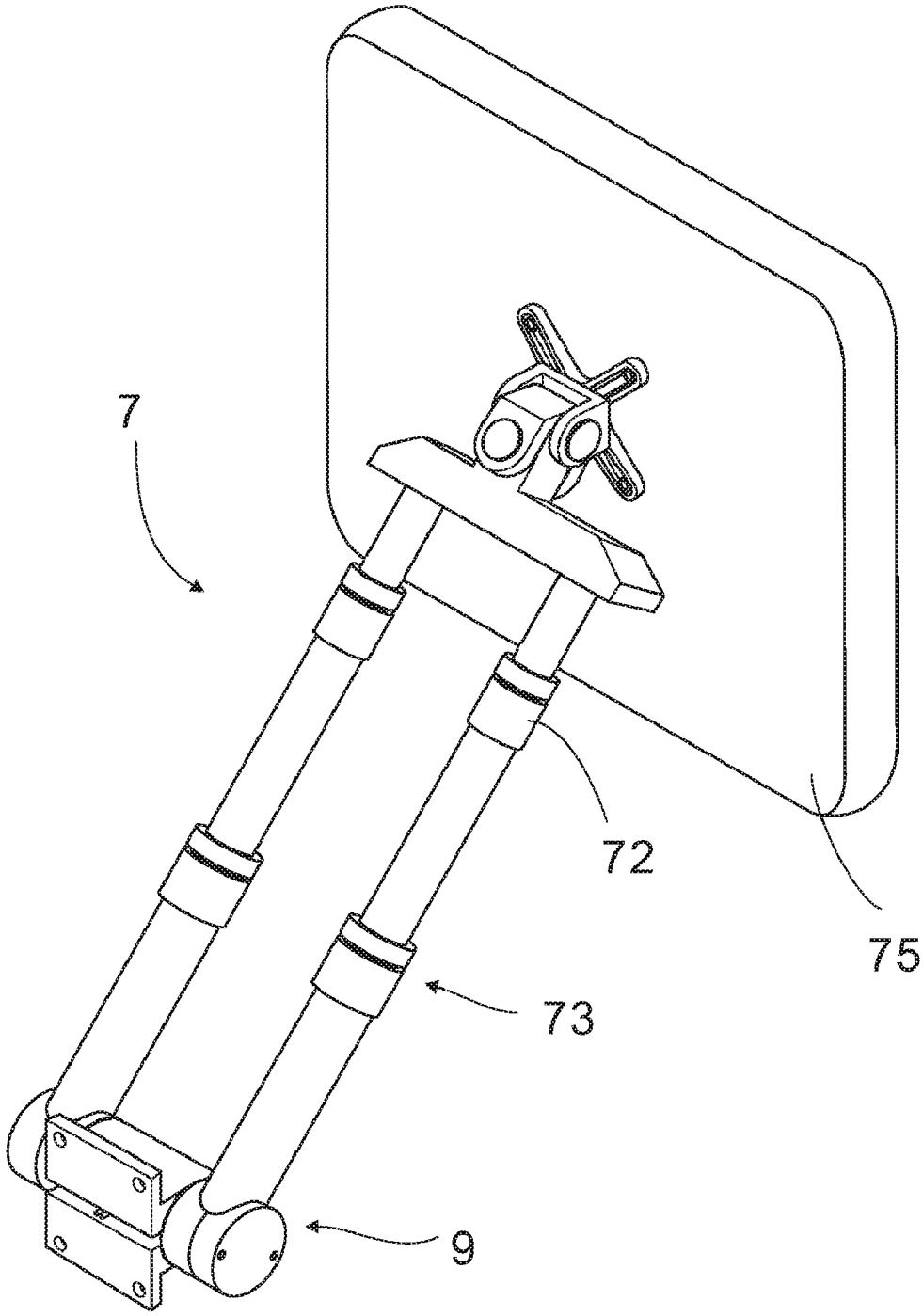
FIG. 3 is a perspective view of the telescopic and pivotal board.
Figure 5:
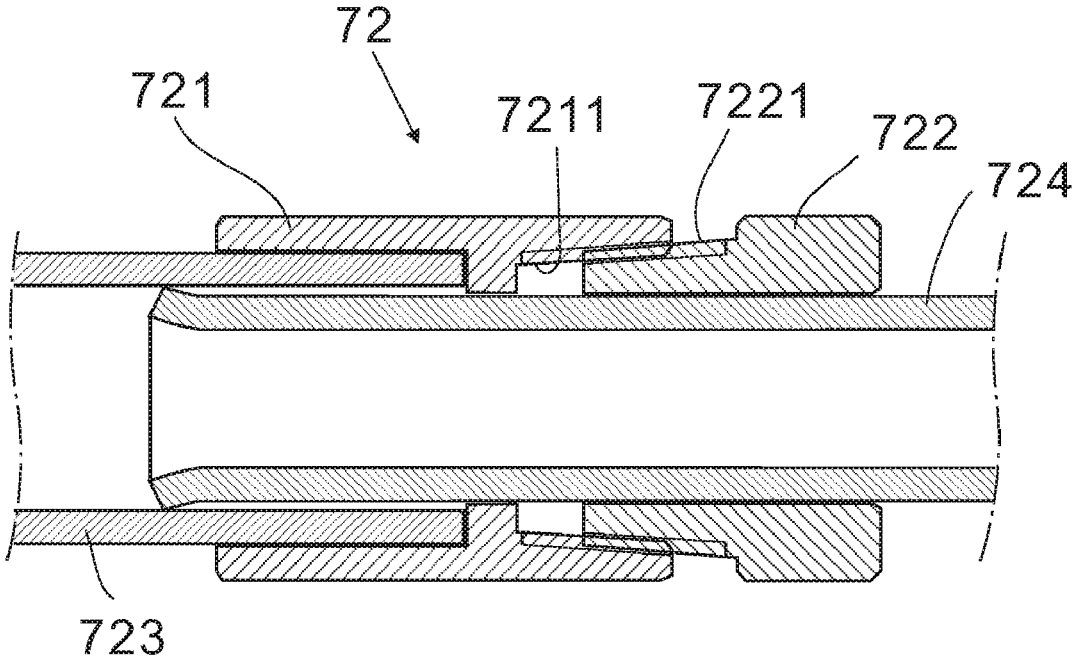
FIG. 5 is a cross-sectional view of the joint of FIG. 3.
Figure 6:
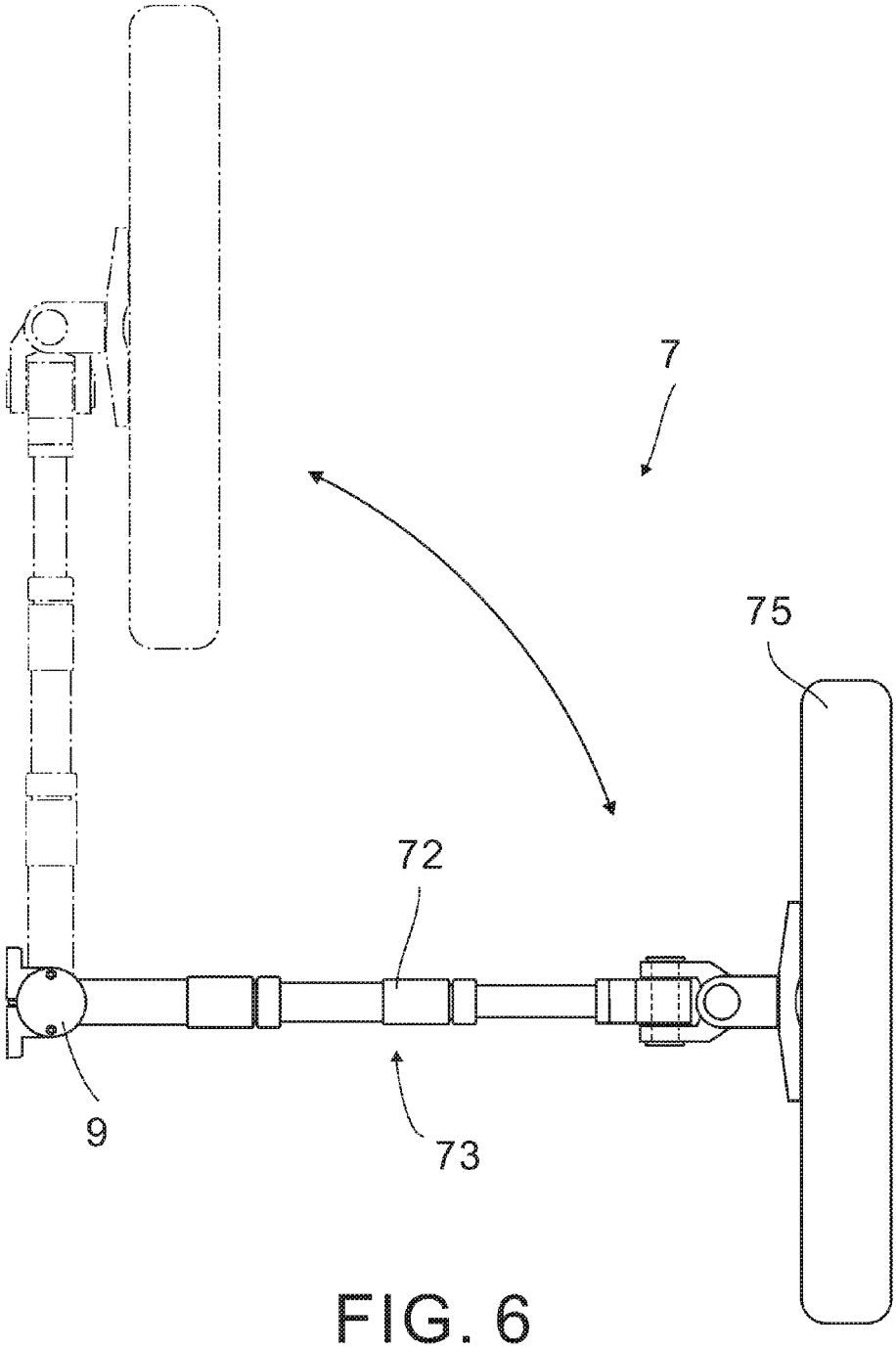
FIG. 6 is a side elevation of the telescopic and pivotal board showing a pivotal operation thereof.
Figure 7:
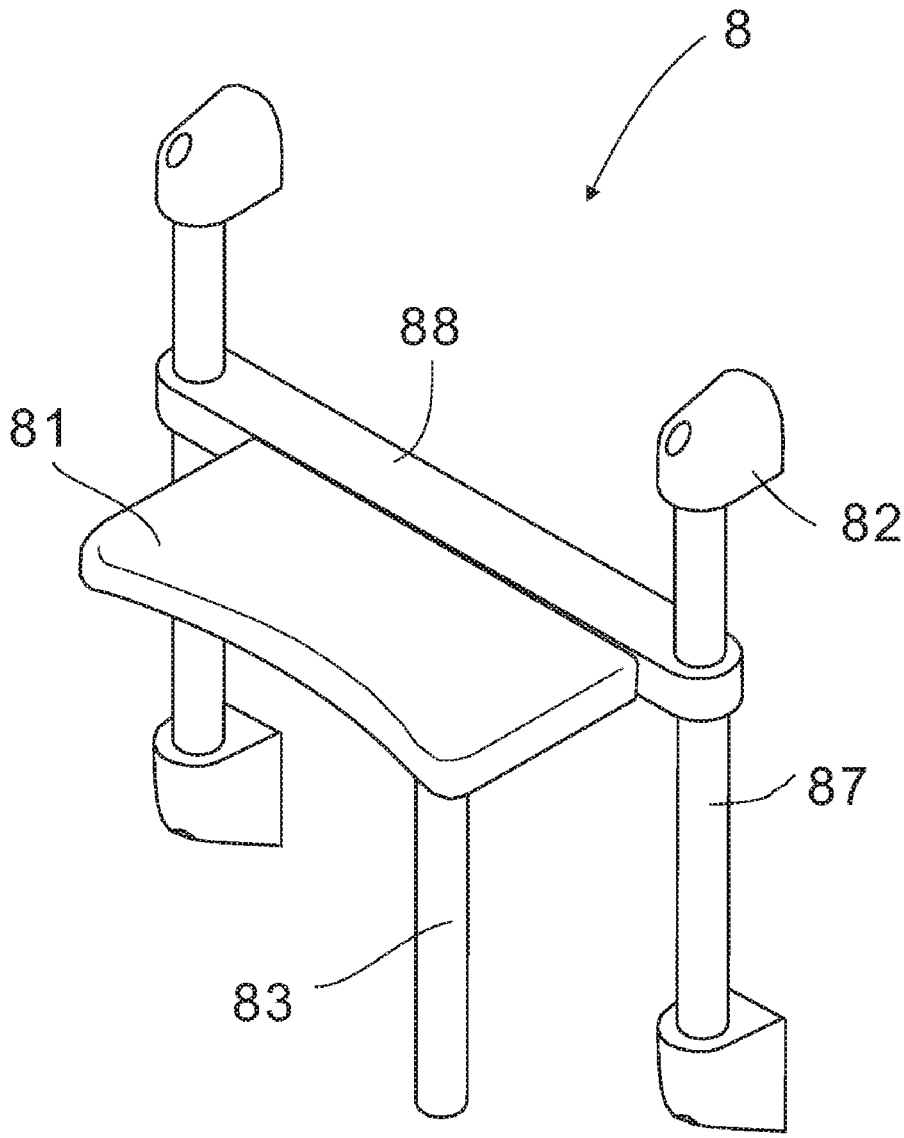
FIG. 7 is a perspective view of the seat assembly of FIG. 2.
Figure 8:
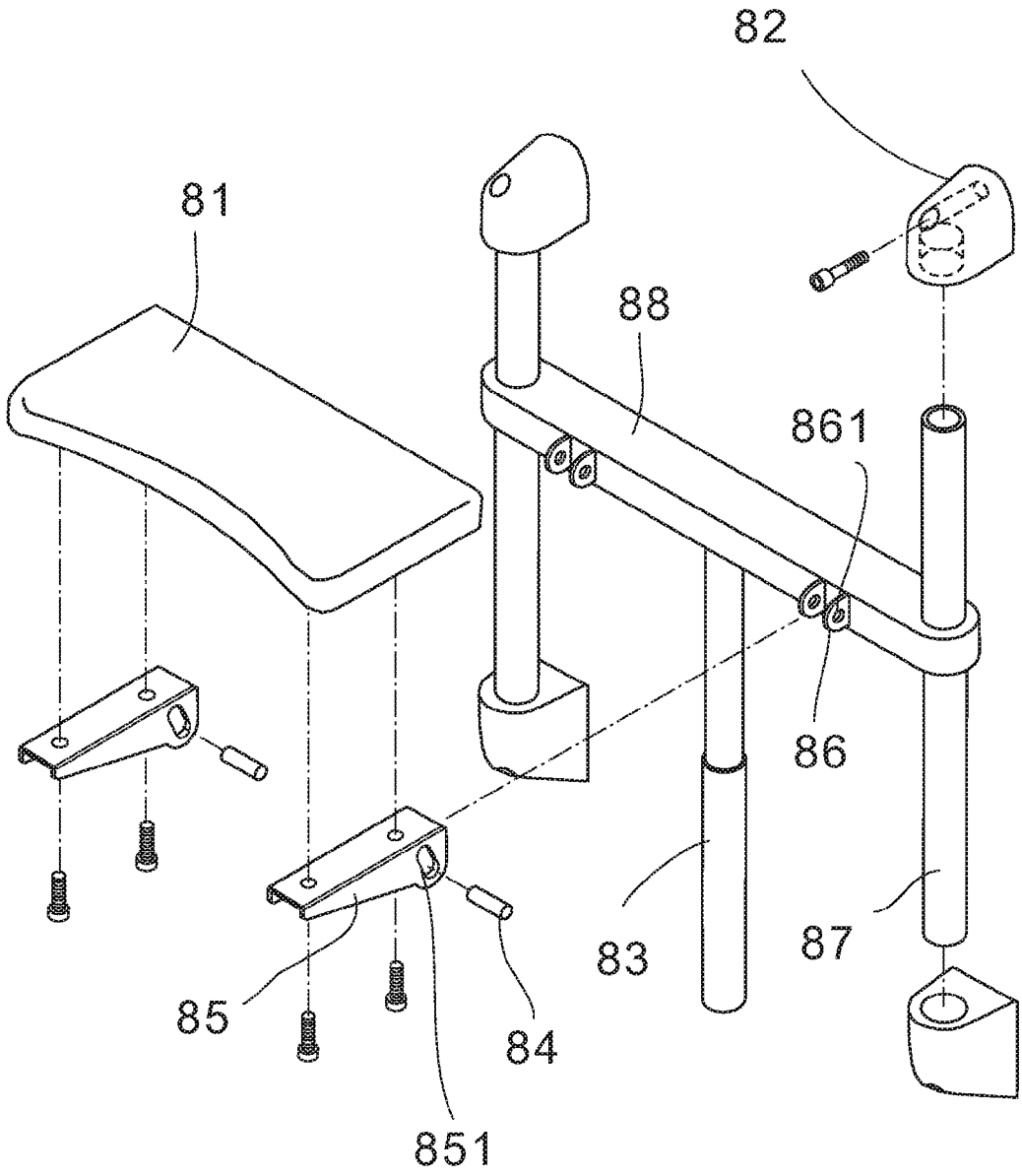
FIG. 8 is an exploded view of the seat assembly shown in FIG. 7.

Referring to FIGS. 1 to 12, a health booth in accordance with a preferred embodiment of the invention is shown. The booth is rectangular in cross-section and comprises a front door 1 having a handle 12 for opening or closing same, and an opening 11 to the right of an upper portion of the handle 12. The opening 11 is fitted with a glass window.

The booth further comprises a rectangular top 3, a rectangular bottom 2 having a positioning hole 21, a rectangular rear wall 6 having a mesh structure 61, a rectangular first side wall 4 comprising, on its inner surface, an upper loudspeaker 41, a multimedia panel 43 beside the loudspeaker 41, a mirror 42 fitted in the multimedia panel 43, and a mesh structure 44 under the multimedia panel 43, and a rectangular second side wall 5 opposite the first side wall 4, the second side wall 5 having a mesh structure 51 on its inner surface.

The booth further comprises a telescopic and pivotal board 7 mounted between the multimedia panel 43 and the mesh structure 44 when it is retracted, and a seat assembly 8 mounted onto the mesh structure 51.

The telescopic and pivotal board 7 comprises a board 75 having a mesh structure outer surface, two parallel telescopic units 73 each having one end pivotably attached to the rear surface of the board 75 and the other end pivotably secured to a pivot assembly 9, each telescopic unit 73 including two joints 72.

For example, the joint 72 proximate to the pivot assembly 9 comprises a sleeve 721 having internal threads 7211 on a portion of an inner surface, a support tube 723 having one end secured to the pivot assembly 9 as detailed later and the other end fastened in the sleeve 721 and spaced from the internal threads 7211 by an annular rim (not numbered), a sliding tube 724 slidably disposed in the support tube 723, and a plastic sleeving fastener 722 with the sliding tube 724 passing through, the sleeving fastener 722 having external threads 7221 on a tapered circumferential surface. The external threads 7221 are adapted to threadedly engage with the internal threads 7211 so as to secure the sleeve 721, the sleeving fastener 722, and the sliding tube 724 together after adjusting the lengths of the telescopic units 73 to desired ones.

The pivot assembly 9 comprises a channel 91 of substantially C-section mounted onto the first side wall 4 between the multimedia panel 43 and the mesh structure 44, the channel 91 having two open ends and a side opening 911, two inner cylindrical members 94 each having a disc-shaped well (not numbered) facing either end of the channel 91, and an aperture 941, two aligned torsion springs 92 in the channel 91, one torsion spring 92 having one end anchored in the side opening 911 and the other end anchored in the aperture 941, the other torsion spring 92 having one end anchored in the aperture 941 and the other end anchored in the side opening 911, a bolt 93 of square section inserted through the torsion springs 92 and having both ends fastened in the inner cylindrical members 94 respectively, two outer cylindrical members 96 each together with one of the inner cylindrical members 94 to form a through hole (not numbered) with the support tube 723 disposed therein, and two groups of two bolts 95 in which each group of two bolts 95 are driven through the outer cylindrical member 96 into the inner cylindrical member 94 to fasten the end of the support tube 723. Hence, a pivotal movement of the telescopic and pivotal board 7 is made possible (see FIG. 6). That is, the pivotal movement of the telescopic and pivotal board 7 (i.e., the support tubes 723) will twist the ends of the torsion springs 92 anchored in the apertures 941 via the inner cylindrical members 94. Further, the weight of the board 75 is prevented from falling due to the support by the pivot assembly 9 (mainly by the torsion springs 92).

The seat assembly 8 comprises four mounting blocks 82 arranged as a rectangle and threadedly mounted on the second side wall 5, two columns 87 each having both ends mounted in the upper and lower mounting blocks 82 of the same side, a horizontal bar 88 having both ends slidably put on the columns 87, a telescopic support post 83 having an upper end secured to the bottom center of the horizontal bar 88 and a lower end fastened in the positioning hole 21, a seat 81, two spaced brackets 85 threadedly secured to an underside of the seat 81, each bracket 85 having two opposite, elongated, slanted slots 851, two sets of two lugs 86 each having a through hole 861, and two lock pins 84 each driven through the through hole 861 of one lug 86 of one set, the slots 851, and the through hole 861 of the other lug 86 of one set.

Figure 9:
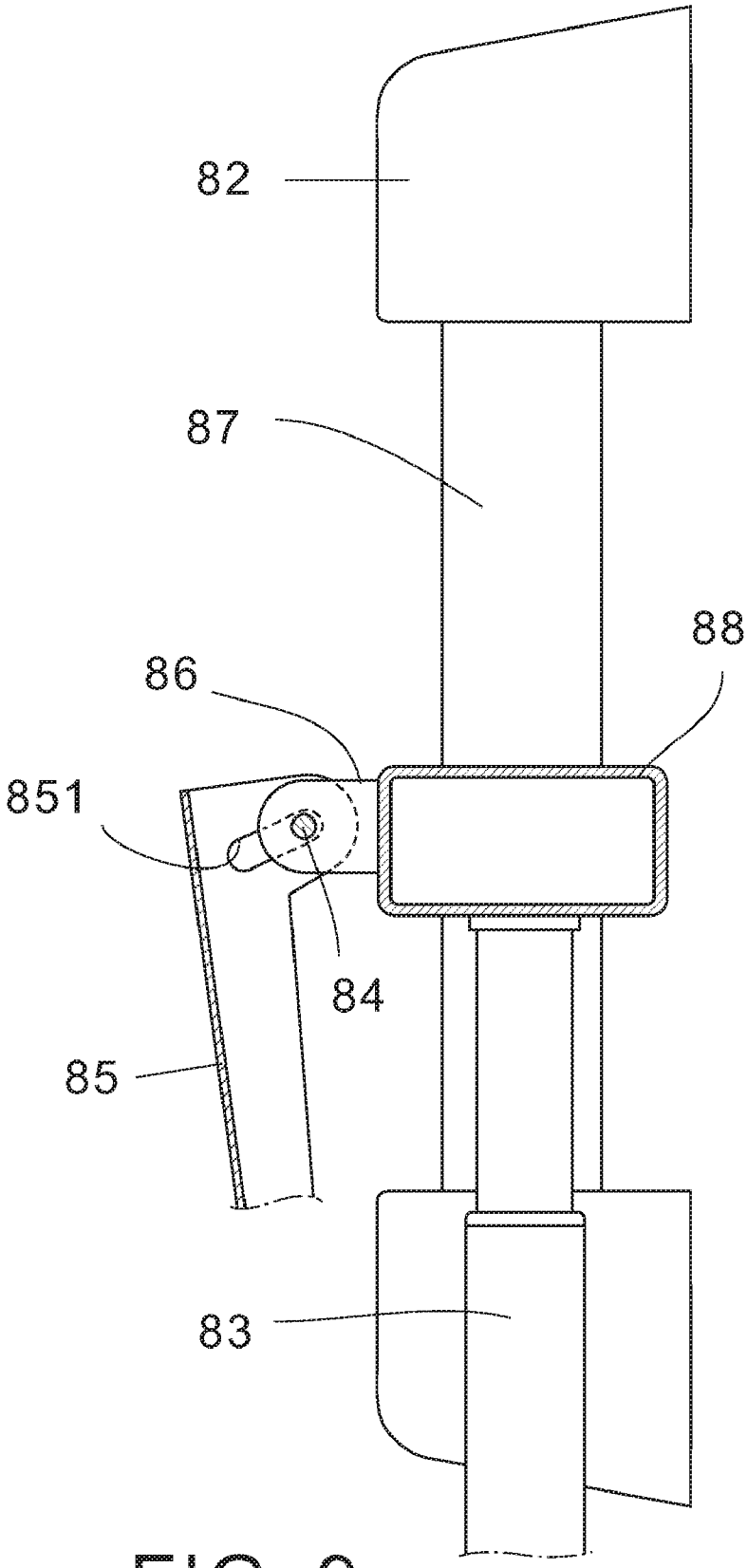
FIG. 9 is a longitudinal sectional view of the seat assembly of FIG. 7 showing a collapsed position of the bracket.
Figure 10:
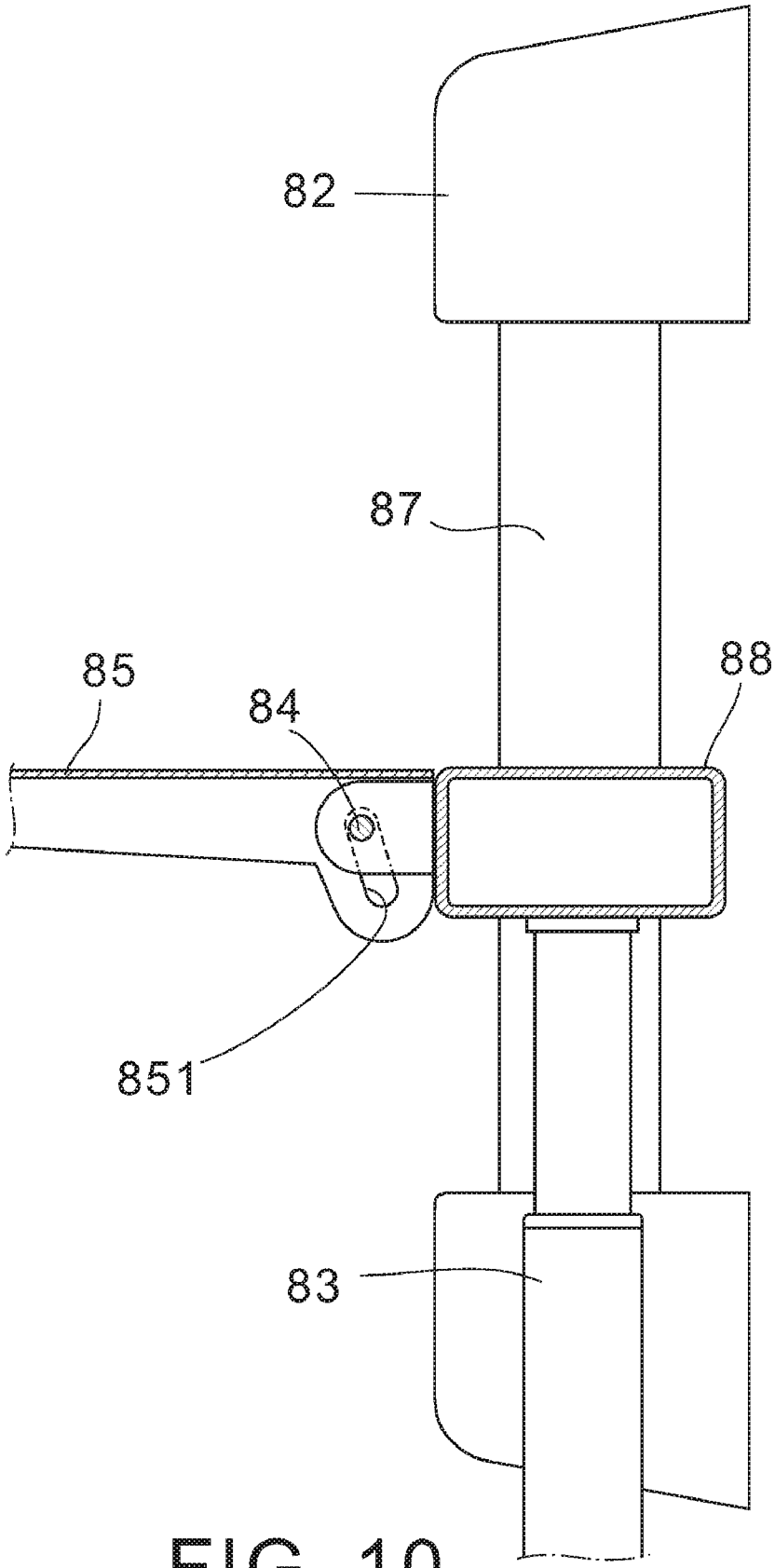
FIG. 10 is a view similar to FIG. 9 showing an extended position of the bracket.

An occupant may clockwise pivot the substantially downward oriented brackets 85 and press down the brackets 85 until the brackets 85 are about flush with the top of the horizontal bar 88 (see FIGS. 9 and 10). It is shown that the lock pin 84 moves from one end of the slot 851 (see FIG. 9) to the other end of the slot 851 (see FIG. 10). At the position shown in FIG. 10, the end portions of the brackets 85 are urged against the horizontal bar 88 and are thus prevented from counterclockwise pivoting.

Figure 11:
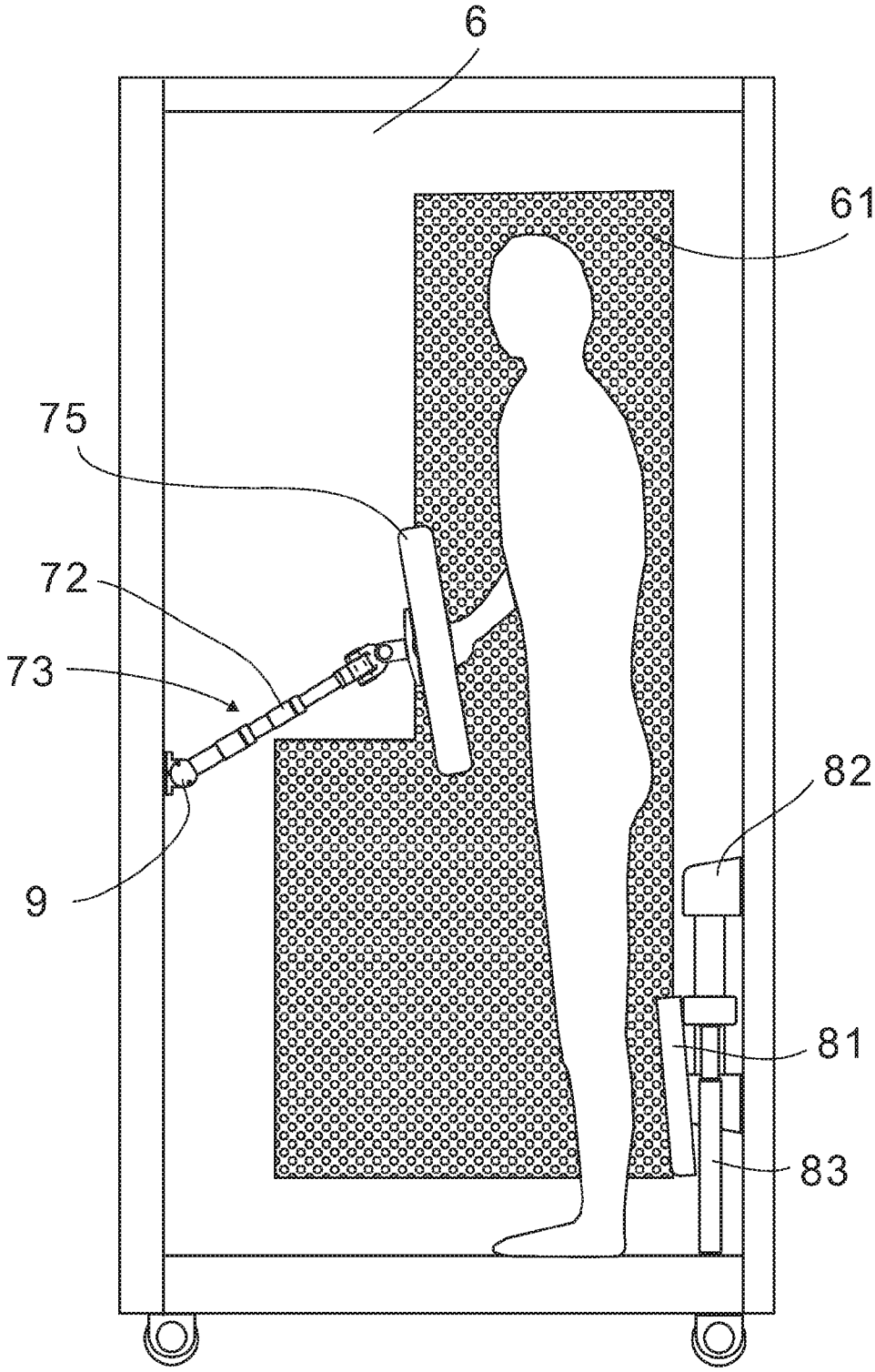
FIGS. 11 and 12 are side elevations of the interior of the health booth showing an occupant entered for health exposure.
Figure 12:
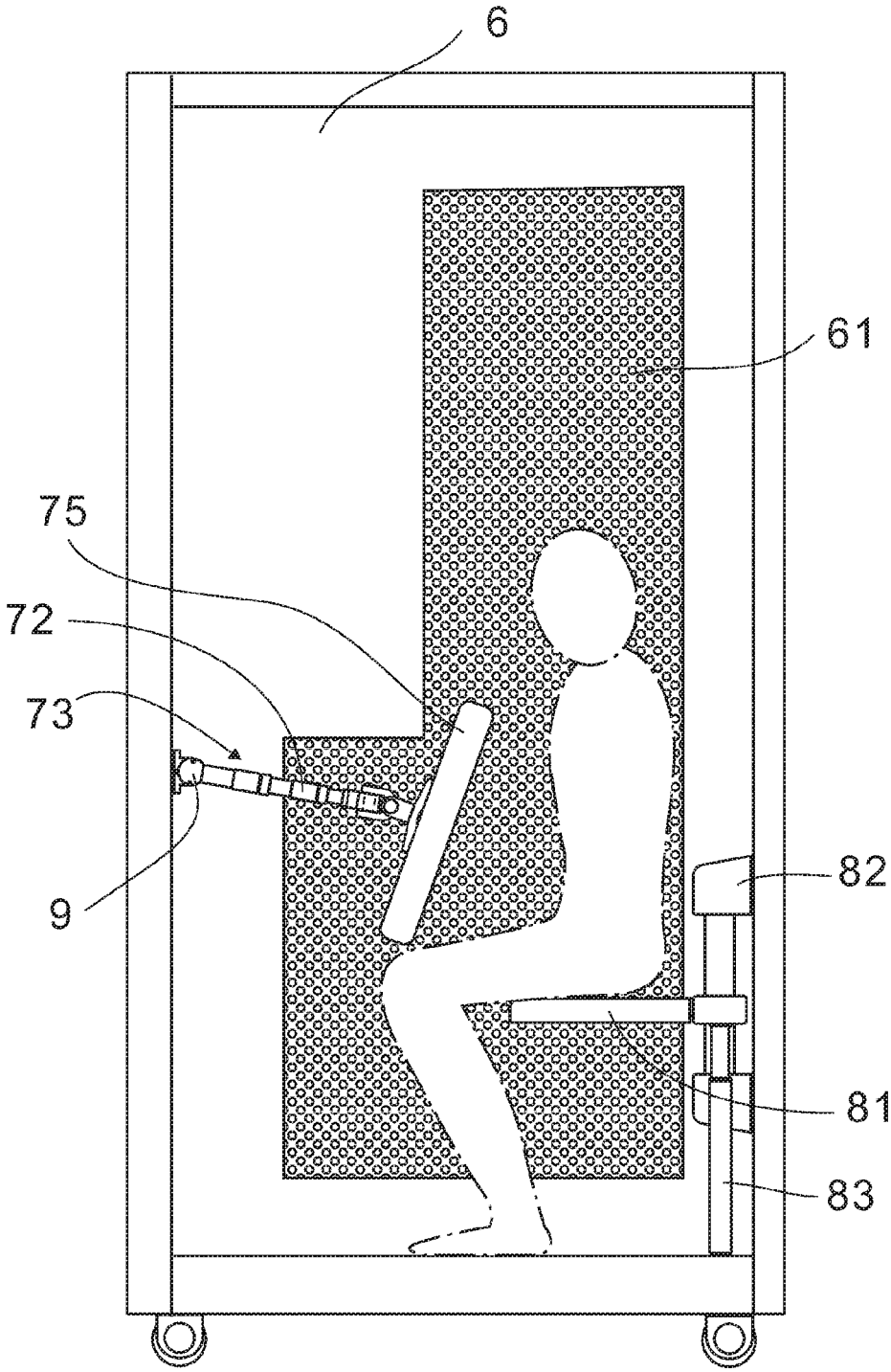

As shown in FIGS. 11 and 12, the occupant may stand to hold the board 75 with the seat 81 being retracted or sit on the seat 81 by pivoting the seat 81 to a horizontal position.

An IR generator (not shown) for generating IR waves, an FIR IR generator (not shown) for generating FIR waves, a pulsed low frequency generator (not shown), or the like may be installed in each mesh structure. Hence, the above devices may bring beneficial health effects to various parts of an occupant in the booth.

Moreover, the provisions of the loudspeaker 41 and the multimedia panel 43 can let the occupant enjoy his or her staying in the booth.

While the invention herein disclosed has been described by means of specific embodiments, numerous modifications and variations could be made thereto by those skilled in the art without departing from the scope and spirit of the invention set forth in the claims.

What is claimed is:

1. A health enclosure comprising:

a door (1);

a rectangular top (3);

a rectangular bottom (2) having a positioning hole (21);

a rectangular rear wall (6);

a rectangular first side wall (4);

a rectangular second side wall (5) opposite the first side wall (4);

a telescopic and pivotal board (7) comprising a board (75) and two parallel telescopic units (73) each having one end pivotably attached to the board (75);

a seat assembly (8) comprising two parallel columns (87) mounted on the second side wall (5), a horizontal bar (88) having both ends slidably put on the columns (87), a telescopic support post (83) having an upper end secured to the horizontal bar (88) and a lower end fastened in the positioning hole (21), and a collapsible seat (81) secured to the horizontal bar (88), and a pivot assembly (9) comprising a channel (91) of substantially C-section mounted onto the first side wall (4), the channel (91) having a side opening (911), two inner cylindrical members (94) each having an aperture (941), two aligned biasing members (92) in the channel (91) wherein one biasing member (92) has one end anchored in the side opening (911) and the other end anchored in the aperture (941), and the other biasing member (92) has one end anchored in the aperture (941) and the other end anchored in the side opening (911), a bolt (93) inserted through the biasing members (92) and having both ends fastened in the inner cylindrical members (94) respectively, two outer cylindrical members (96) each together with one of the inner cylindrical members (94) to dispose the other ends of the telescopic units (73) therein, and two groups of a plurality of fasteners (95) wherein each group of the fasteners (95) are driven through the outer cylindrical member (96) into the inner cylindrical member (94) to fasten the other ends of the telescopic units (73) so that a pivotal movement of the telescopic units (73) twists the ends of the torsion springs (92) anchored in the apertures (941) via the inner cylindrical members (94).

2. The health enclosure of claim 1, wherein the seat (81) comprises two spaced brackets (85) threadedly secured to an underside, each bracket (85) having two opposite, elongated, slanted slots (851), two sets of two lugs (86) each having a through hole (861), and two lock pins (84) each mounted through the through hole (861) of one lug (86) of either set, the slots (851), and the through hole (861) of the other lug (86) of the same set.

3. The health enclosure of claim 1, wherein each of the telescopic units (73) comprises a support tube (723) secured to the outer and inner cylindrical members (96, 94), a sliding tube (724) slidably disposed in the support tube (723) and having one end pivotably attached to the board (75), and at least one joint (72) each including a sleeve (721) having internal threads (7211) and a plastic sleeving fastener (722) with the sliding tube (724) passing through, the sleeving fastener (722) having external threads (7221) on a tapered circumferential surface, the external threads (7221) are operable to secure to the internal threads (7211) so as to fasten the sleeve (721), the sleeving fastener (722), and the sliding tube (724) together.

* * * * *